US012059025B2

(12) United States Patent
Qian et al.

(10) Patent No.: US 12,059,025 B2
(45) Date of Patent: Aug. 13, 2024

(54) HEAT-NOT-BURN CIGARETTE

(71) Applicant: Ningbo Yilan Yasi Skin Care Products Co., Ltd., Zhejiang (CN)

(72) Inventors: Xuli Qian, Zhejiang (CN); Qijun Ye, Zhejiang (CN)

(73) Assignee: Ningbo Yilan Yasi Skin Care Products Co., Ltd., Zhejiang (CN)

( * ) Notice: Subject to any disclaimer, the term of this patent is extended or adjusted under 35 U.S.C. 154(b) by 407 days.

(21) Appl. No.: 17/685,377

(22) Filed: Mar. 3, 2022

(65) Prior Publication Data

US 2022/0395019 A1 Dec. 15, 2022

(30) Foreign Application Priority Data

Jun. 10, 2021 (CN) ..... 202110647790.2

(51) Int. Cl.
*A24D 1/20* (2020.01)
*A24D 1/02* (2006.01)

(52) U.S. Cl.
CPC ..... *A24D 1/20* (2020.01); *A24D 1/02* (2013.01)

(58) Field of Classification Search
CPC ..... A24D 1/20; A24D 1/02
USPC ..... 131/329
See application file for complete search history.

(56) References Cited

U.S. PATENT DOCUMENTS

| | | | | |
|---|---|---|---|---|
| 5,649,554 | A * | 7/1997 | Sprinkel | A24F 40/465 131/194 |
| 2015/0209530 | A1* | 7/2015 | White | A24D 1/20 128/200.23 |
| 2018/0192691 | A1* | 7/2018 | Richmond | A24D 1/20 |
| 2019/0133187 | A1* | 5/2019 | Spencer | A24F 40/46 |
| 2019/0133188 | A1* | 5/2019 | Spencer | A24F 42/60 |
| 2019/0307177 | A1* | 10/2019 | Maeder | A24F 40/51 |
| 2020/0093177 | A1* | 3/2020 | Han | A24D 3/06 |
| 2021/0059307 | A1* | 3/2021 | Engqvist | A24D 1/20 |

* cited by examiner

*Primary Examiner* — Gary F Paumen
(74) *Attorney, Agent, or Firm* — JCIPRNET

(57) ABSTRACT

A heat-not-burn cigarette includes a shell, a driving assembly, and a locking mechanism. The shell is provided with an opening and an accommodation cavity. The opening communicates the accommodation cavity with an outside world. The locking mechanism is provided in the accommodation cavity. The driving assembly is transmissively connected to the locking mechanism to drive the locking mechanism to form a smaller clamping ring and a larger clamping ring. The locking mechanism includes a bearing assembly and at least one transmission assembly. The bearing assembly is adjustably connected to the transmission assembly, and the transmission assembly is connected to the driving assembly, so as to provide preset tracks for the bearing assembly. The bearing assembly expands or contracts along the preset tracks, such that the bearing assembly is adjustably attached to a peripheral side of a cigarette body.

15 Claims, 9 Drawing Sheets

HEAT-NOT-BURN CIGARETTE

CROSS-REFERENCE TO RELATED APPLICATION

This application claims the priority benefit of China application serial no. 202110647790.2, filed on Jun. 10, 2021. The entirety of the above-mentioned patent application is hereby incorporated by reference herein and made a part of this specification.

BACKGROUND

Technical Field

The present invention relates to the technical field of electronic cigarettes, and in particular to a heat-not-burn cigarette.

Description of Related Art

Traditional electronic cigarettes (e-cigarettes) are low-pressure microelectronic atomization devices that do not require ignition. Most e-cigarettes are powered by rechargeable lithium batteries. The e-liquid containing nicotine and flavorings in the atomizer is atomized into droplets by electric current, which resemble the smoke produced by smoking cigarettes. However, unlike traditional cigarettes that use tobacco and endanger the health of both smokers and non-smokers when burned, the e-liquid used by e-cigarettes is free from tar and other harmful ingredients found in traditional cigarettes, and it will not produce secondhand smoke.

At present, the atomization type e-cigarettes on the market are controversial and are strictly regulated due to their harmfulness. In recent years, heat-not-burn cigarettes are becoming increasingly popular. The heat-not-burn cigarettes create smoke by heating tobacco with a heating plate to a temperature sufficient for atomization but not for burning of tobacco, typically 220-350° C. Since there is no open flame, they will not produce carcinogens such as tar caused by burning of traditional cigarettes, but instead can make the tobacco taste like traditional cigarettes.

However, the existing heat-not-burn cigarettes still have the following defects. (1) The current commercially available heat-not-burn cigarettes are bulky, and the tobacco as a whole is heated by air that is heated to, for example, 220-350° C., in the heating chamber, which is power-consuming, inefficient, and requires larger batteries. (2) The butt of a cigarette must be removed as a filter first, which causes waste of the cigarette. (3) It is hard to fix cigarettes of different sizes, and some heat-not-burn cigarettes are even designed only for specific types of cigarettes, but not for commercially available ordinary cigarettes, resulting in limited application.

SUMMARY

An objective of the present invention is to provide a heat-not-burn cigarette which can overcome the shortcomings of the prior art. The heat-not-burn cigarette can rapidly heat a cigarette body by directly contacting a surface of the cigarette body, and it is compact and easy to carry and use.

Another objective of the present invention is to provide a heat-not-burn cigarette. The heat-not-burn cigarette can be adjusted by a locking mechanism to suit cigarette bodies of different diameters, and realize rapid heating of the cigarette body by allowing heating plates to be in close attachment to a peripheral side of the cigarette body. In addition, the heat-not-burn cigarette has a compact structure, improves heating efficiency, reduces power consumption, and reduces power usage requirements.

Still another objective of the present invention is to provide a heat-not-burn cigarette. The heat-not-burn cigarette is universal, suitable for commercially available thin cigarettes and thick cigarettes, and is easy to adjust, safe and reliable.

In order to achieve the above objectives, the present invention adopts the following technical solution. A heat-not-burn cigarette includes a shell, a driving assembly, and a locking mechanism. The shell is provided with an opening and an accommodation cavity. The opening communicates the accommodation cavity with an outside world. The locking mechanism is provided in the accommodation cavity. The driving assembly is transmissively connected to the locking mechanism to drive the locking mechanism to form a smaller clamping ring and a larger clamping ring. The locking mechanism includes a bearing assembly and at least one transmission assembly. The bearing assembly is adjustably connected to the transmission assembly, and the transmission assembly is connected to the driving assembly, so as to provide preset tracks for the bearing assembly. The bearing assembly expands or contracts along the preset tracks, such that the bearing assembly is adjustably attached to a peripheral side of a cigarette body.

Preferably, the transmission assembly includes a rotating disc and a guiding disc. The driving assembly is transmissively connected to the rotating disc. The bearing assembly is movably connected to the guiding disc and the rotating disc, and the preset tracks are formed between the rotating disc and the guiding disc, such that the bearing assembly moves clockwise outward or counterclockwise inward along the preset tracks.

Preferably, the rotating disc is provided with a plurality of limiting slots. The limiting slots are circumferentially provided on an inner surface of the rotating disc. The guiding disc is provided with a plurality of guiding slots, and the guiding slots are spaced apart along a circumference of the guiding disc. Each of the limiting slots and a respective one of the guiding slots are partially variably provided relative to each other, and the rotating disc is rotatable relative to the guiding disc, such that overlapping areas between the limiting slots and the guiding slots form the preset tracks, respectively.

Preferably, the guiding disc is provided with a plurality of guiding walls. The guiding walls are respectively located on inner sides of the guiding slots. The bearing assembly includes a plurality of positioning portions and a plurality of heating plates. The positioning portions respectively extend from the heating plates to the limiting slots of the rotating disc, and the heating plates face the cigarette body to heat the cigarette body. Positioning slots are formed between the positioning portions and the heating plates, respectively, and the guiding walls are respectively accommodated in the positioning slots, such that the positioning portions connect the guiding slots and the limiting slots, respectively.

Preferably, the positioning portions each are provided with a first side portion and a second side portion. The first side portion and the second side portion are respectively located on two sides of each of the positioning portions. The first side portion and the second side portion are slidably in contact with side surfaces of each of the limiting slots, respectively, such that the positioning portions are respectively radially slidable along the limiting slots.

Preferably, the guiding walls extend from an inner circumference of the guiding disc to an outer circumference of the guiding disc in a bend or a curved arc. The positioning portions clamp the guiding walls in the positioning slots, respectively. The guiding disc has a ring structure, and the guiding slots are arranged obliquely from the inner circumference of the guiding disc to the outer circumference of the guiding disc. The guiding slots each are wider in a middle portion than on two sides.

Preferably, the guiding walls each are provided with a first inner section and a second inner section. The second inner section integrally obliquely extends outward from the first inner section, and the first inner section extends obliquely inward. The first inner section and the second inner section of each of the guiding walls are in a bent structure, and the first inner section and the second inner section define an angle of 160° to 170°.

Preferably, the rotating disc is provided with a driving portion and a limiting portion. The driving portion is axially located outside the limiting portion, the driving portion is rotatably connected to the driving assembly, and the limiting slots are spaced apart on an inner surface of the limiting portion.

Preferably, two transmission assemblies are provided. Two of the positioning portions are respectively located at two ends of each of the heating plates. The transmission assemblies are respectively connected to two ends of the bearing assembly. The heating plates extend axially to be attached to the peripheral side of the cigarette body. The driving assembly includes a driving wheel, a pair of driven wheels, a transmission rod and driving supports. The driving wheel and the driven wheels are axially arranged along the transmission rod. The driving wheel is driven by a driving motor or manually. The driven wheels are respectively located at two ends of the transmission rod, and the driven wheels are respectively engaged with driving portions of rotating discs of the two transmission assemblies. The driving portions of the rotating discs each have a gear-shaped structure. The transmission rod penetrates the driving supports, guiding discs of the two transmission assemblies are respectively fixed to the driving supports, and the driven wheels are axially located outside the driving supports, respectively.

Preferably, the heat-not-burn cigarette further includes a power supply assembly and a control module. The control module is electrically connected to the power supply assembly, and the control module is used to control a heating process and/or a driving process of the bearing assembly. The first side portion and the second side portion are arc surfaces. The heating plates are electrically connected to the control module and the power supply assembly. The heating plates are electrothermal ceramic plates. The electrothermal ceramic plates are made of one or more selected from a group consisting of an oxide ceramic, a carbide ceramic, a nitride ceramic, and a boride ceramic. The limiting slots each have a U-shaped structure. The guiding slots each have a parallelepiped structure. The guiding slots each are provided with a first outer section and a second outer section. The first outer section and the second inner section are arranged oppositely and in parallel, and the second outer section and the first inner section are arranged oppositely and in parallel. The guiding walls each are bent at an angle of 164° to 166°.

DESCRIPTION OF THE EMBODIMENTS

Figure 1:
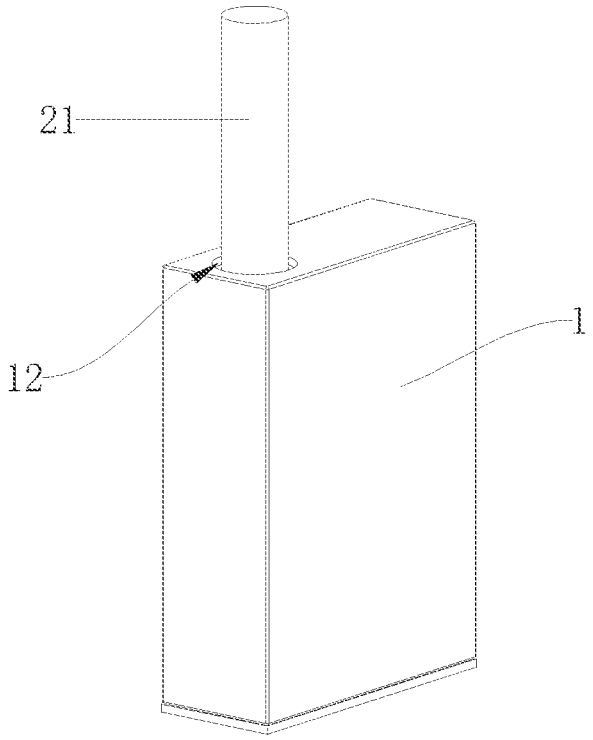
FIG. 1 is a three-dimensional view of a heat-not-burn cigarette according to an embodiment of the present invention.
Figure 2:
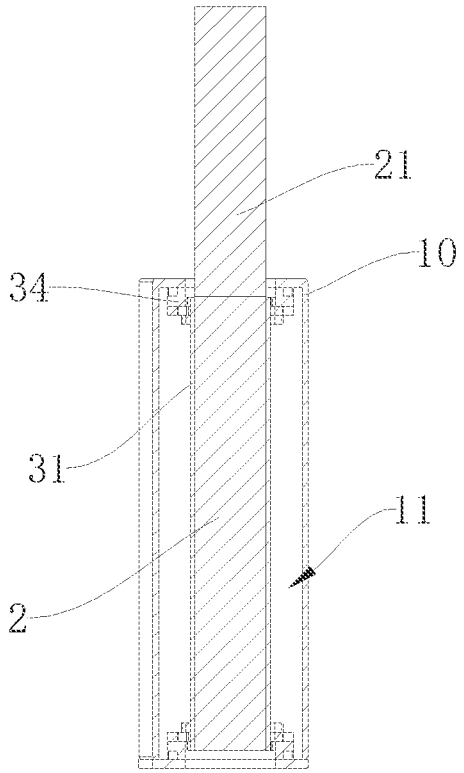
FIG. 2 is a sectional view of the heat-not-burn cigarette according to an embodiment of the present invention.
Figure 3:
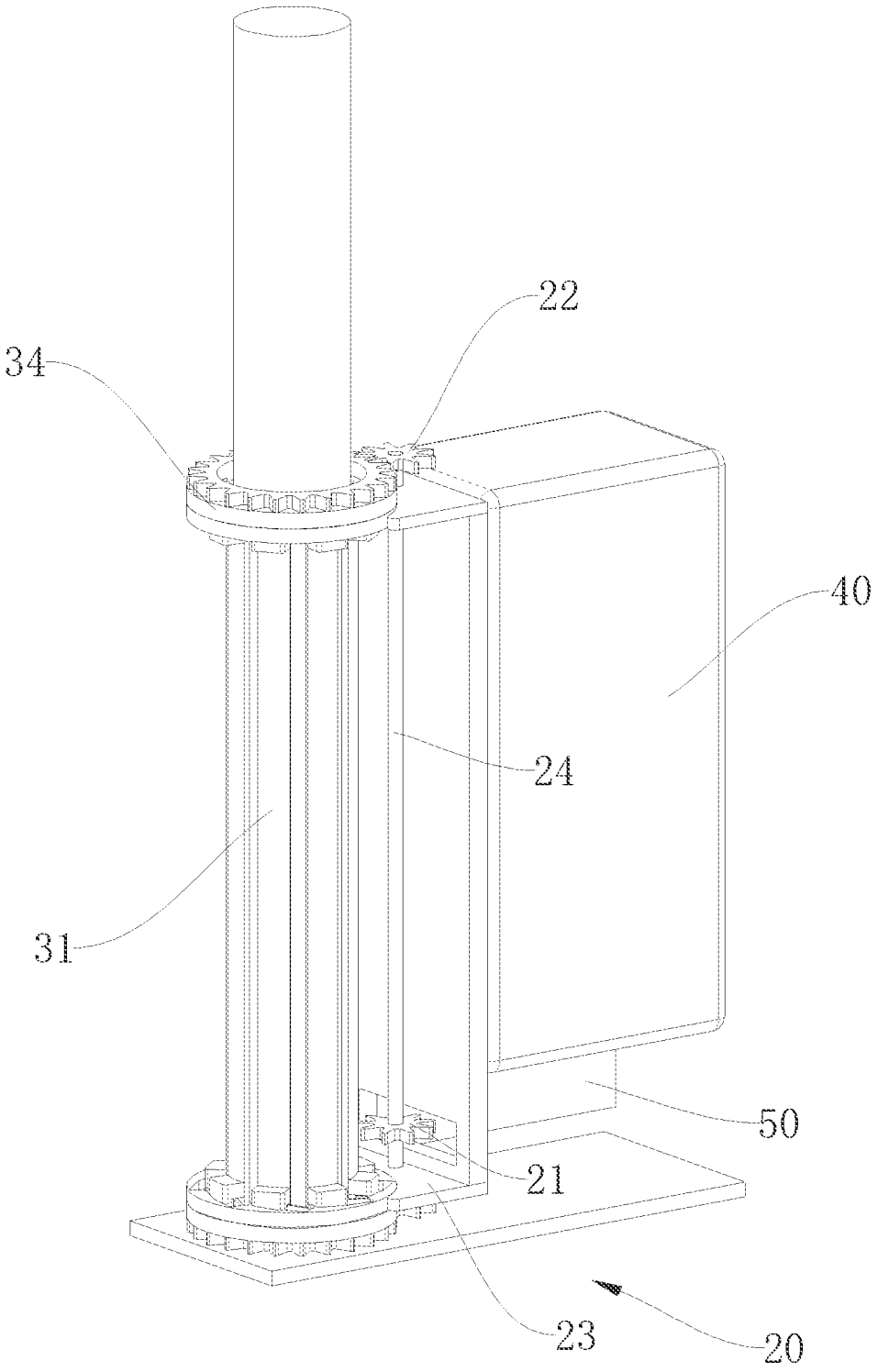
FIG. 3 is a structural view of the heat-not-burn cigarette according to an embodiment of the present invention.
Figure 4:
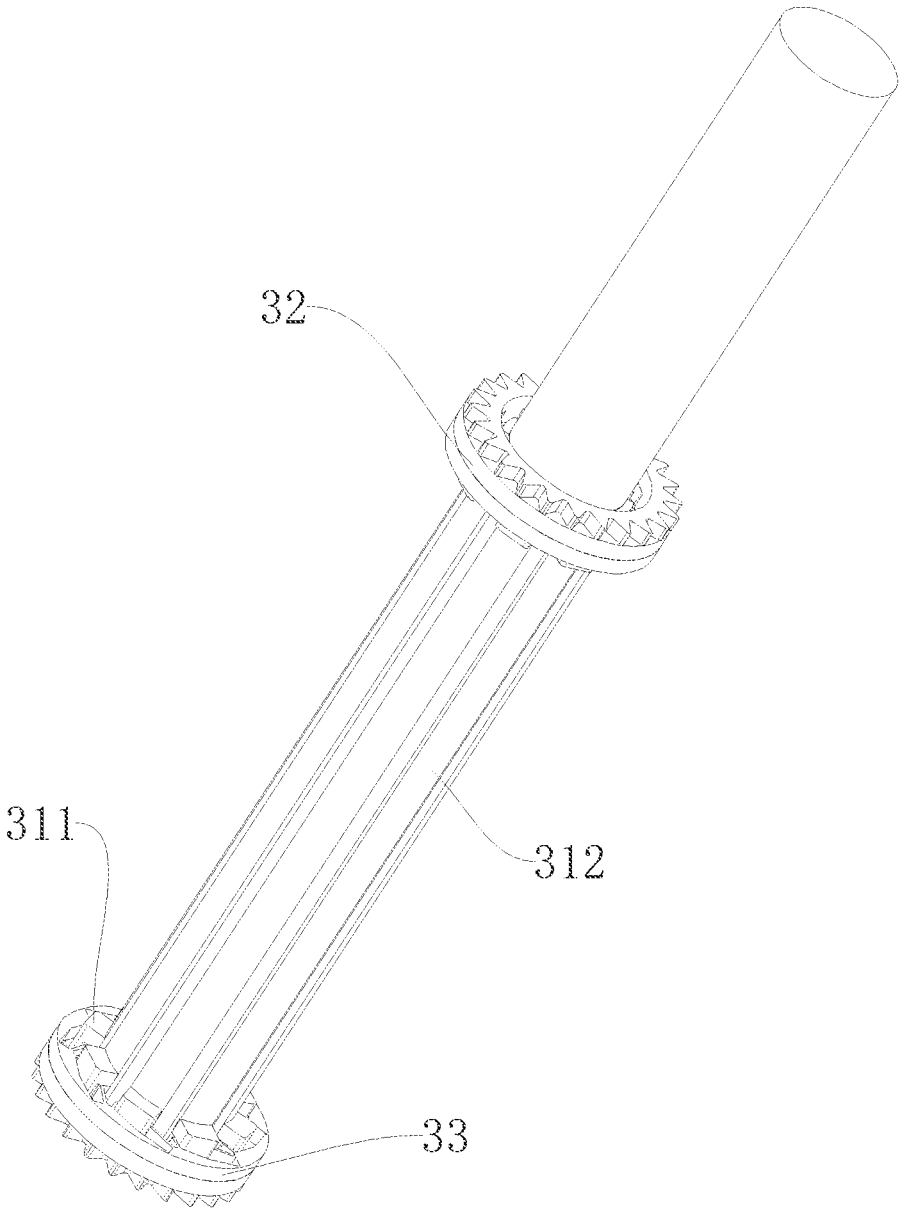
FIG. 4 is a structural view of a locking mechanism of the heat-not-burn cigarette according to an embodiment of the present invention.
Figure 5:
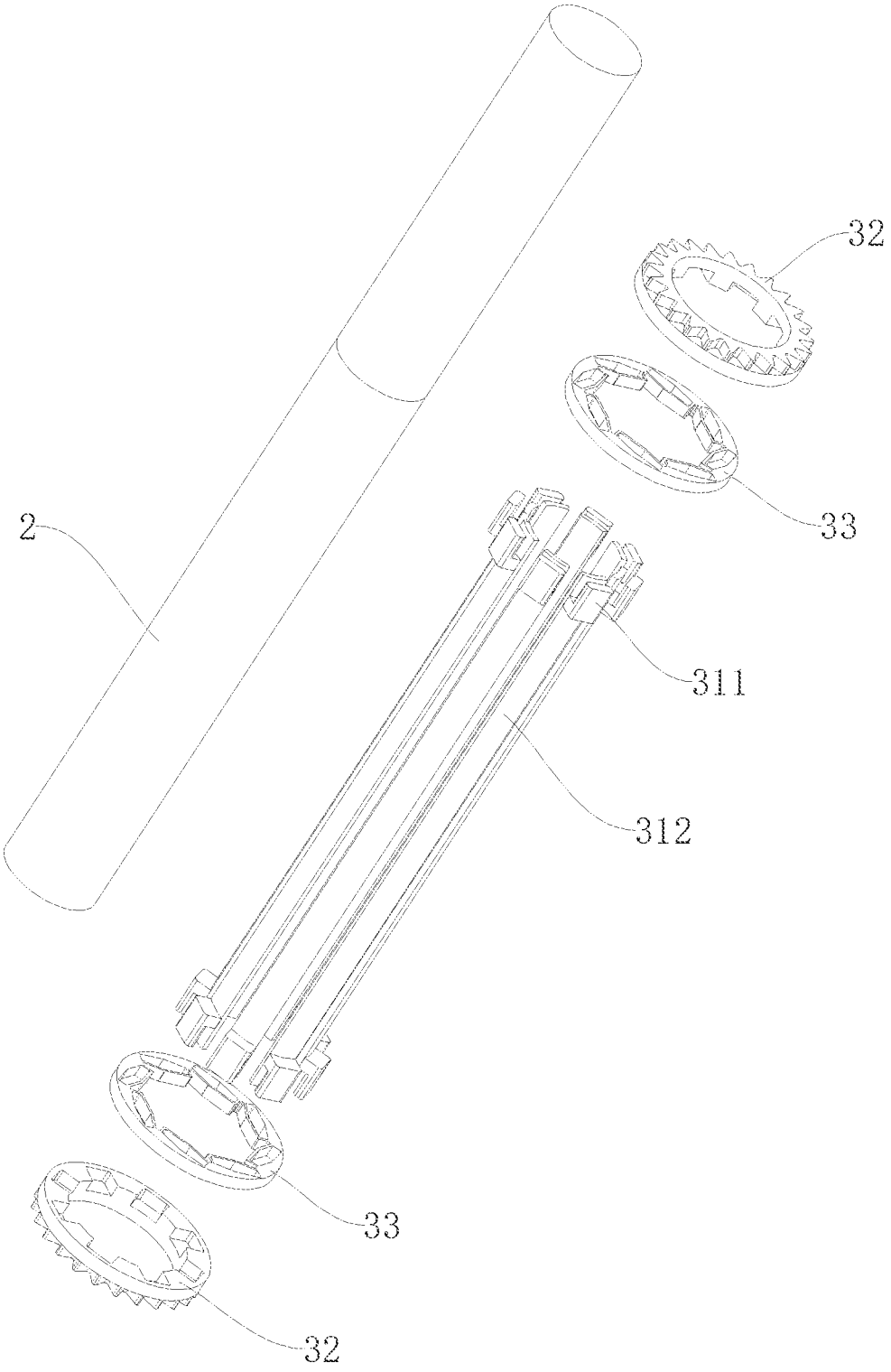
FIG. 5 is an exploded view of the locking mechanism of the heat-not-burn cigarette according to an embodiment of the present invention.

The present invention will be further described below with reference to specific implementations. It should be noted that, the various embodiments or technical features described below may be combined arbitrarily to form new embodiments in case of no conflict.

It should be understood that, in the description of the present invention, the terms such as "central", "longitudinal", "transverse", "long", "wide", "thick", "upper", "lower", "front", "back", "left", "right", "vertical", "horizontal", "top", "bottom", "inner", "outer", "clockwise" and "anticlockwise" are intended to indicate orientations shown in the drawings. It should be noted that these terms are merely intended to facilitate a simple description of the present invention, rather than to indicate or imply that the mentioned apparatus or elements must have the specific orientation or be constructed and operated in the specific orientation. Therefore, these terms may not be construed as a limitation to the present invention.

It should be noted that the terms such as "first" and "second" in the specification and claims of the present invention are intended to distinguish between similar objects, rather than to necessarily indicate a specific order or sequence.

Moreover, the terms "include", "comprise" and their variants mean to cover a non-exclusive inclusion. For example, a process, method, system, product or device that includes a list of steps or units is not necessarily limited to those steps or units which are clearly listed. Instead, they may include other steps or units which are not expressly listed or inherent.

It should be noted that, in the present invention, terms such as "substantially" and "about" are used to represent approximations, not degrees, and are intended to describe inherent deviations in measured or calculated values that would be understood by those of ordinary skill in the art.

In the description of the present invention, it should be noted that, unless otherwise clearly specified, meanings of terms "provide", "install", "connected with", and "connected to" should be understood in a board sense. For example, the connection may be a fixed connection, a removable connection, or an integral connection; may be a mechanical connection or an electrical connection; may be a direct connection, contact connection or an indirect connection by using an intermediate medium; or may be intercommunication between two components. Those of ordinary skill in the art may understand specific meanings of the above terms in the present invention based on a specific situation.

A first aspect of the present invention provides a heat-not-burn cigarette 1. As shown in FIG. 1 to FIG. 12, the heat-not-burn cigarette 1 includes a shell 10, a driving assembly 20, and a locking mechanism 30. The shell 10 is provided with an opening 12 and an accommodation cavity 11. The opening 12 communicates the accommodation cavity 11 with an outside world. The locking mechanism 30 is provided in the accommodation cavity 11. The driving assembly 20 is transmissively connected to the locking mechanism 30 to drive the locking mechanism 30 to form a smaller clamping ring and a larger clamping ring. The locking mechanism 30 includes a bearing assembly 31 and at least one transmission assembly 34. The bearing assembly 31 is adjustably connected to the transmission assembly 34. The transmission assembly 34 is connected to the driving assembly 20 to provide preset tracks for the bearing assembly 31. The bearing assembly 31 expands or contracts along the preset tracks, such that the bearing assembly 31 is adjustably attached to a peripheral side of a cigarette body 2. The heat-not-burn cigarette rapidly heats the cigarette body 2 by directly contacting a surface of the cigarette body 2, and it is compact and easy to carry and use.

In some embodiments, the heat-not-burn cigarette 1 further includes a power supply assembly 40 and a control module 50. The control module 50 is electrically connected to the power supply assembly 40, and the control module 50 is used to control a heating process and/or a driving process of the bearing assembly 31.

In some embodiments, the power supply assembly 40 and the control module 50 are provided in the shell 10 and are spaced apart from the accommodation cavity 11.

In some embodiments, the transmission assembly 34 includes a rotating disc 32 and a guiding disc 33. The driving assembly 20 is transmissively connected to the rotating disc 32. The bearing assembly 31 is rotatably connected to the guiding disc 33 and the rotating disc 32. The preset tracks are formed between the rotating disc 32 and the guiding disc 33, such that the bearing assembly 31 moves clockwise outward or counterclockwise inward along the preset tracks.

In some embodiments, the rotating disc 32 is provided with a plurality of limiting slots 323. The limiting slots 323 are circumferentially provided on an inner surface of the rotating disc 32. The guiding disc 33 is provided with a plurality of guiding slots 331. The guiding slots 331 are spaced apart along a circumference of the guiding disc 33. Each of the limiting slots 323 and a respective one of the guiding slots 331 are partially variably provided relative to each other. The rotating disc 32 is rotatable relative to the guiding disc 33, such that the preset tracks are respectively formed between the limiting slots 323 and the guiding slots 331. In other words, the limiting slots 323 and the guiding slots 331 are always partially overlapped to form overlapping areas as the preset tracks for the bearing assembly 31 to rotate. When the rotating disc 32 rotates, the limiting slots 323 are displaced relative to the guiding slots 331, and the overlapping areas between the limiting slots 323 and the guiding slots 331 change accordingly. The bearing assembly 31 moves along the overlapping areas between the limiting slots 323 and the guiding slots 331 to expand outward and contract inward.

In some embodiments, the guiding disc 33 is provided with a plurality of guiding walls 332. The guiding walls 332 are respectively located on inner sides of the guiding slots 331. The bearing assembly 31 includes a plurality of positioning portions 311 and a plurality of heating plates 312. The positioning portions 311 respectively extend from the heating plates 312 to the limiting slots 323 of the rotating disc 32. The heating plates 312 face the cigarette body 2. Positioning slots 313 are formed between the positioning portions 311 and the heating plates 312, respectively. The guiding walls 332 are respectively accommodated in the positioning slots 313, such that the positioning portions 311 connect the guiding slots 331 and the limiting slots 323, respectively. When the rotating disc 32 rotates, the positioning portions 311 move along the preset tracks formed by the overlapping of the guiding slots 331 and the limiting slots 323. Thus, the positioning portions 311 rotate with the limiting slots 323, and the positioning portions 311 are displaced relative to the guiding slots 331.

In some embodiments, the positioning portions 311 each are provided with a first side portion 314 and a second side portion 315. The first side portion 314 and the second side portion 315 are respectively located on two sides of each of the positioning portions 311. The first side portion 314 and the second side portion 315 are slidably in contact with side surfaces of each of the limiting slots 323, respectively, such that the positioning portions 311 are respectively radially slidable along the limiting slots 323 and are respectively limited to fixed positions of the guiding slots 331. When the limiting slots 323 rotate, the side surfaces of the limiting slots 323 push the first side portions 314 or the second side portions 315 of the positioning portions 311 in contact therewith to rotate. Meanwhile, the overlapping areas of the limiting slots 323 and the guiding slots 331 are changed, such that the first side portions 314 and the second side portions 315 of the positioning portions 311 move radially inward or outward along the side surfaces of the limiting slots 323.

In some embodiments, "moving radially inward or outward" means moving in a direction orthogonal to a central axis of the rotating disc 32, i.e., radially, toward the central axis or away from the central axis.

In some embodiments, the first side portion 314 and the second side portion 315 are arc surfaces or in other shape.

In some embodiments, the guiding walls 332 extend from an inner circumference of the guiding disc 33 to an outer circumference of the guiding disc 33 in a bend or a curved arc. The positioning portions 311 clamp the guiding walls 332 in the positioning slots 313, respectively. The guiding disc 33 has a ring structure, and the guiding slots 331 are arranged obliquely from the inner circumference of the guiding disc to the outer circumference of the guiding disc. The guiding slots 331 each are wider in a middle portion than on two sides, and the guiding walls 332 are located inside the guiding disc 33. This design facilitates the positioning portions 311 of the bearing assembly 31 to move outward or inward along the guiding walls 332.

In some embodiments, the guiding walls 332 each are provided with a first inner section 333 and a second inner section 334. The second inner section 334 integrally obliquely extends outward from the first inner section 333, and the first inner section 333 extends obliquely inward. The first inner section 333 and the second inner section 334 of each of the guiding walls 332 are in a bent structure. The first inner section 333 has a length adapted to a respective one of the positioning portions 311. The first inner section 333 and the second inner section 334 each may also have a curved structure. Since commercially available cigarette bodies 2 generally have two specifications, thick and thin, the first inner section 333 and the second inner section 334 of each of the guiding walls 332 preferably have a bent structure. When the first inner sections 333 are respectively located in the positioning slots 313, the bearing assembly 31 is in a smaller clamping ring state, which is suitable for locking a thin cigarette. According to a usage habit, it takes a period of time to maintain the smaller clamping ring state. The bent structure of the first inner section 333 and the second inner section 334 is convenient to maintain the smaller clamping ring state. In order to rotate the rotating disc 32 to enter the larger clamping ring state, it must overcome a certain external force. The design effectively prevents unnecessary loosening of the bearing assembly 31, thereby further locking the thin cigarette.

In some embodiments, the first inner section 333 and the second inner section 334 define an angle $\alpha$ of about 160° to 170°. Preferably, the angle $\alpha$ between the first inner section 333 and the second inner section 334 is about 164° to 166°. That is to say, the guiding walls 332 each bend at the angle $\alpha$ of 164° to 166°.

In some embodiments, in order to maintain the structural stability of the guiding disc 33, the guiding slots 331 each have a parallelepiped structure. The guiding slots 331 each are provided with a first outer section 335 and a second outer section 336. The first outer section 335 and the second inner section 334 are arranged oppositely and in parallel, and the second outer section 336 and the first inner section 333 are arranged oppositely and in parallel.

In some embodiments, two transmission assemblies 34 are provided. Two of the positioning portions 311 are respectively located at two ends of each of the heating plates 312. The transmission assemblies 34 are respectively connected to two ends of the bearing assembly 31. The heating plates 312 extend axially to be attached to the peripheral side of the cigarette body 2. The heating plates 312 are electrically connected to the control module 50 and the power supply assembly 40. The control module 50 is used to control a heating process of the heating plates 312.

Figure 11:
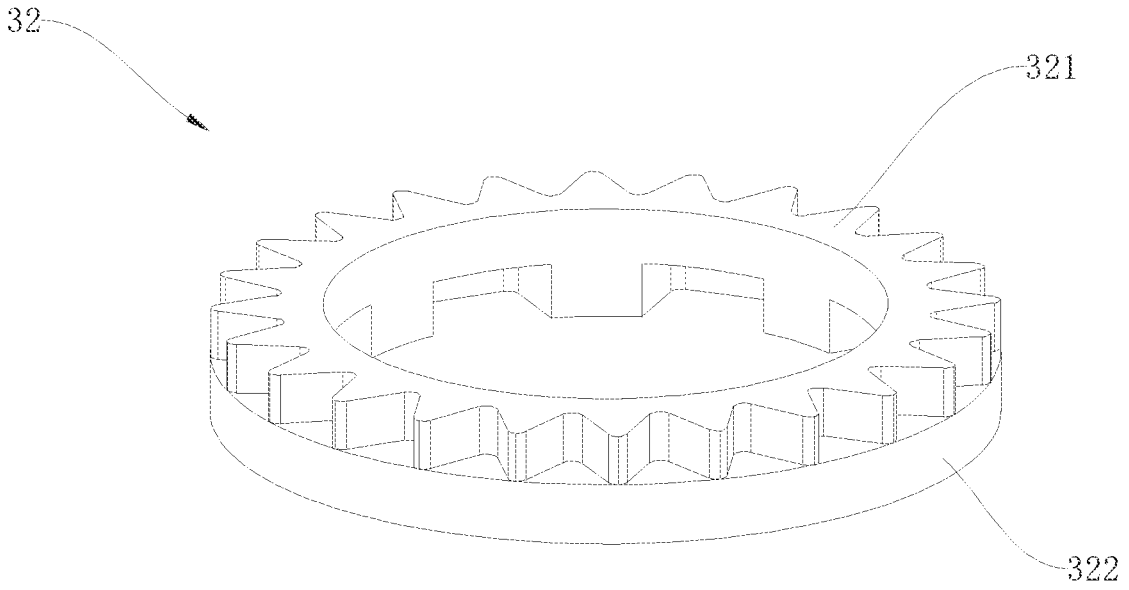
FIG. 11 is a structural view of a rotating disc (with a driving portion facing upward) of the heat-not-burn cigarette according to an embodiment of the present invention.
Figure 12:
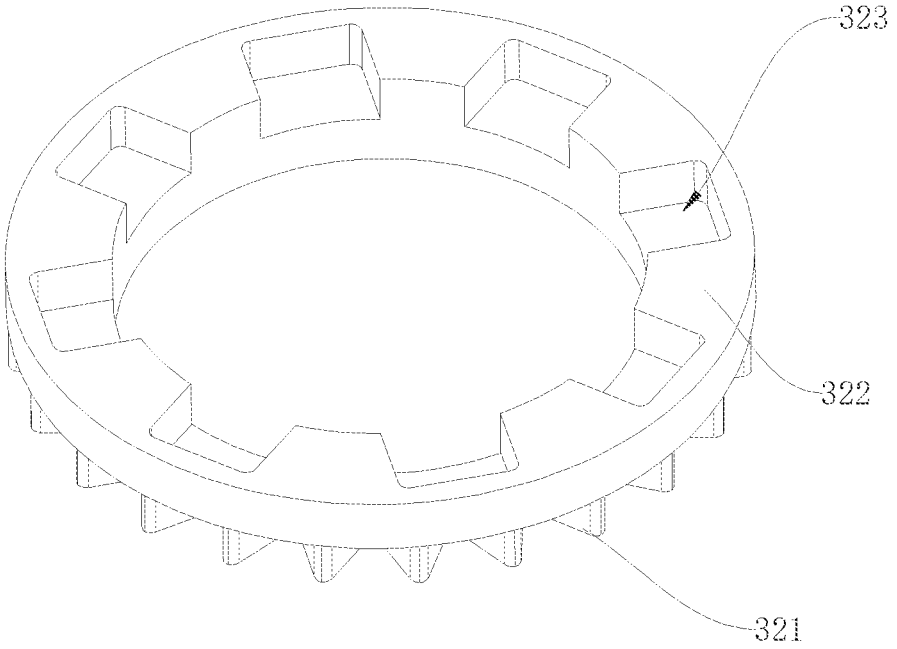
FIG. 12 is a structural view of the rotating disc (with a limiting portion facing upward) of the heat-not-burn cigarette according to an embodiment of the present invention.

In some embodiments, the rotating disc 32 is provided with a driving portion 321 and a limiting portion 322. The driving portion 321 is located outside the limiting portion 322. The driving portion 321 is rotatably connected to the driving assembly 20. The limiting slots 323 are spaced apart on an inner surface of the limiting portion 322. The limiting slots 323 may each have a U-shaped structure, as shown in FIG. 11 and FIG. 12.

In some embodiments, the driving assembly 20 may be controlled by manual actuation and/or automatic actuation. The driving assembly 20 includes a driving wheel 21, a pair of driven wheels 22 and a transmission rod 24. The driving wheel 21 and the driven wheels 22 are axially arranged along the transmission rod 24. The driving wheel 21 may be driven by a driving motor or manually. The driven wheels 22 are respectively located at two ends of the transmission rod 24, and the driven wheels 22 are respectively engaged with driving portions 321 of rotating discs 32 of the two transmission assemblies 34. The driving portions 321 of the rotating discs 32 each have a gear-shaped structure. When the driving wheel 21 rotates, the driven wheels 22 are driven to rotate, thereby driving the rotating discs 32 to rotate clockwise or counterclockwise.

In some embodiments, the driving assembly 20 further includes a pair of driving supports 23. The transmission rod 24 penetrates the driving supports 23. Guiding discs 33 of the two transmission assemblies 34 are respectively fixed to the driving supports 23. The driven wheels 22 are axially located outside the driving supports 23, respectively.

In some embodiments, the heating plates 312 may be electrothermal ceramic plates or metal plates. The heating plates 312 have a circular arc structure. Preferably, the heating plates 312 are electrothermal ceramic plates. Since the bearing assembly 31 directly contacts the cigarette body 2, if metal plates are used, repeated heating will easily lead to corrosion and oxidation of the metal plates. In addition, residual substances of the cigarette body 2 are easy to adhere to the surfaces of the metal plates, and harmful substances such as carbon deposits and tar are easily generated after repeated heating.

In some embodiments, the electrothermal ceramic plates are made of one or more selected from a group consisting of an oxide ceramic, a carbide ceramic, a nitride ceramic, and a boride ceramic. The oxide ceramic is selected from one or more of a group consisting of zirconium oxide ($ZrO_2$), aluminum oxide ($Al_2O_3$), silicon dioxide ($SiO_2$), magnesium oxide (MgO), chromium oxide ($Cr_2O_3$), beryllium oxide (BeO), vanadium pentoxide ($V_2O_5$), boron trioxide ($B_2O_3$), spinel ($MgO{\cdot}Al_2O_3$), zinc oxide (ZnO), yttrium trioxide ($Y_2O_3$), calcium oxide (CaO), cerium dioxide ($CeO_2$), mullite ($3Al_2O_3{\cdot}.2SiO_2$), barium titanate ($BaTiO_3$), lead zirconate titanate ($PbZrTiO_3$), zircon powder ($ZrSiO_4$), and lanthanum chromate ($LaCrO_3$). The carbide ceramic is selected from one or more of a group consisting of silicon carbide (SiC), titanium carbide (TiC), tungsten carbide (WC), zirconium carbide (ZrC), boron carbide ($B_4C$), hafnium carbide (HfC), tantalum carbide (TaC), beryllium carbide ($Be_2C$), uranium carbide (UC), vanadium carbide (VC), niobium carbide (NbC), molybdenum carbide ($Mo_2C$), and molybdenum carbide (MoC). The nitride ceramic is selected from one or more of a group consisting of silicon nitride ($Si_3N_4$), titanium nitride (TiN), boron nitride (BN), aluminum nitride (AlN), carbon nitride ($C_3N_4$), zirconium nitride (ZrN), vanadium nitride (VN), tantalum nitride (TaN), niobium nitride (NbN), and scandium nitride (ScN). The boride ceramic is selected from one or more of a group consisting of titanium boride ($TiB_2$), zirconium boride ($ZrB_2$), molybdenum boride ($Mo_2B$), tungsten boride ($WB_4$), lanthanum boride ($LaB_2$), hafnium boride (HfB), tungsten boride (WB), and circonium boride (ZrB). The electrothermal ceramic material is not limited to those listed above, and other improved electrothermal ceramic material may also be used.

In some embodiments, the electronic device is suitable for cigarette bodies and moxa sticks, and may be used as a heat-not-burn cigarette or a moxa stick heater. It is suitable for cigarettes or moxa sticks of different sizes, or other cylindrical objects.

Figure 6:
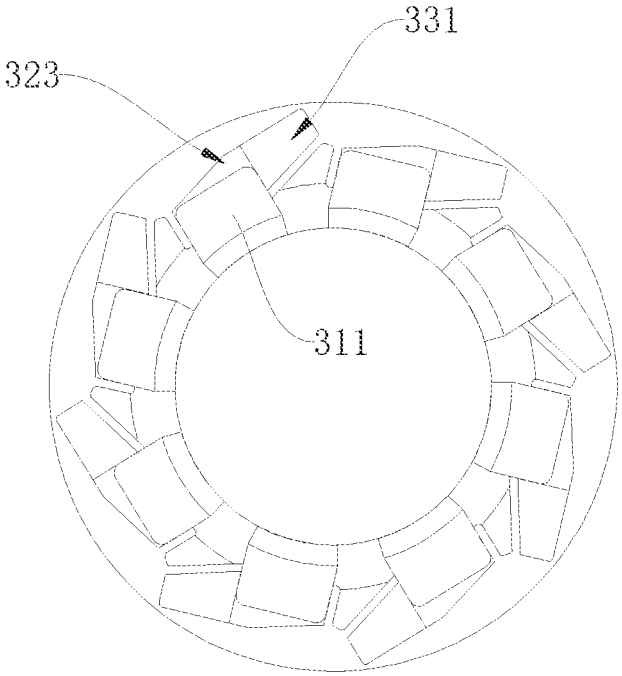
FIG. 6 shows a smaller clamping ring state of the locking mechanism of the heat-not-burn cigarette according to an embodiment of the present invention.
Figure 7:
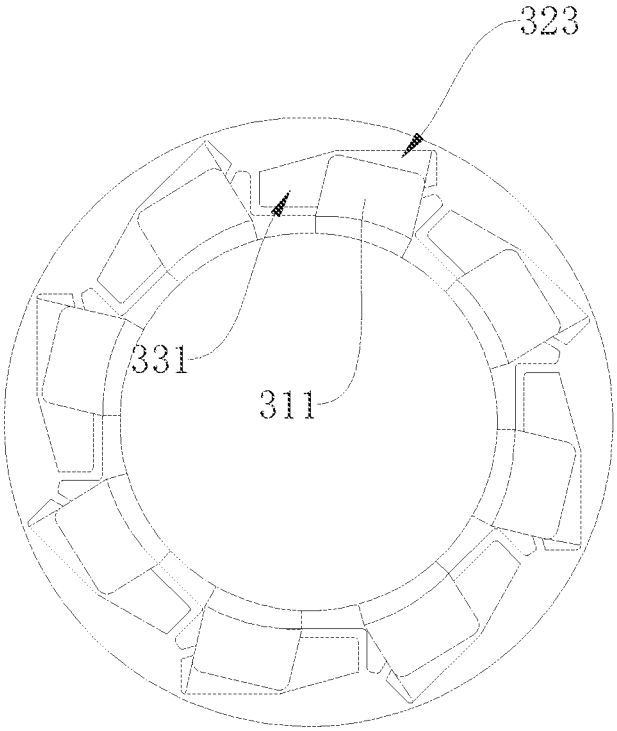
FIG. 7 shows a larger clamping ring state of the locking mechanism of the heat-not-burn cigarette according to an embodiment of the present invention.
Figure 8:
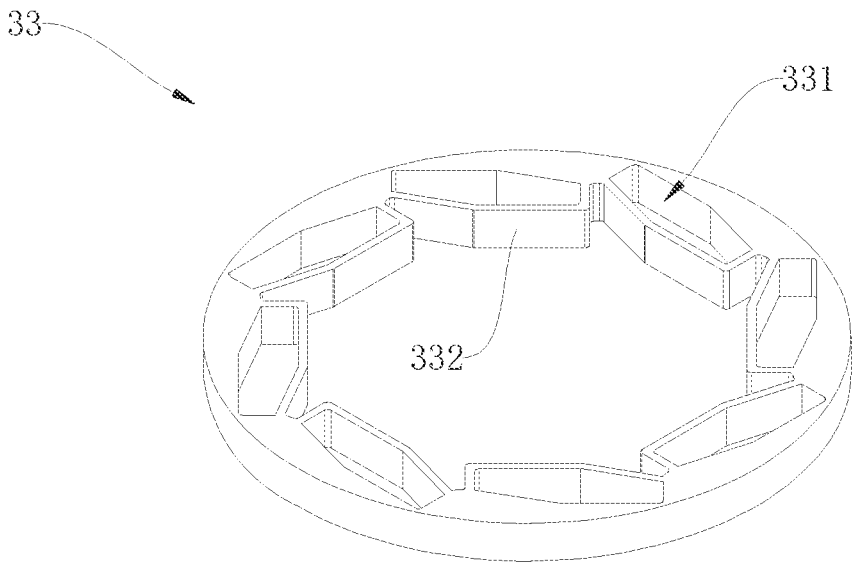
FIG. 8 is a structural view of a guiding disc of the heat-not-burn cigarette according to an embodiment of the present invention.
Figure 9:
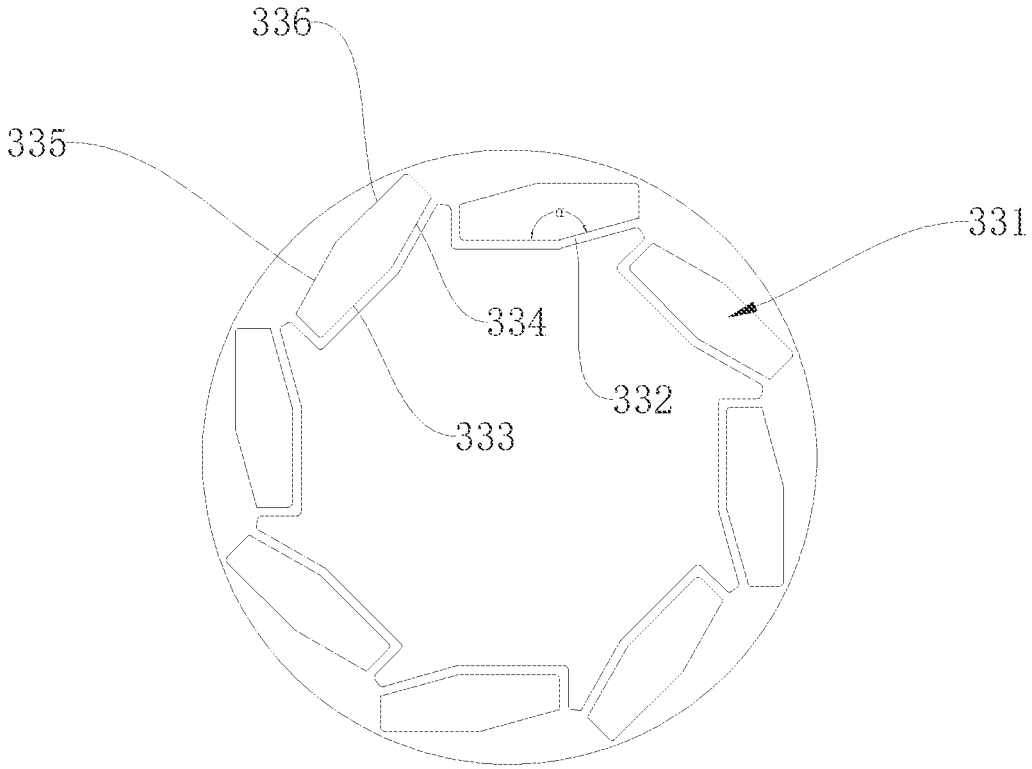
FIG. 9 is a top view of the guiding disc of the heat-not-burn cigarette according to an embodiment of the present invention.
Figure 10:
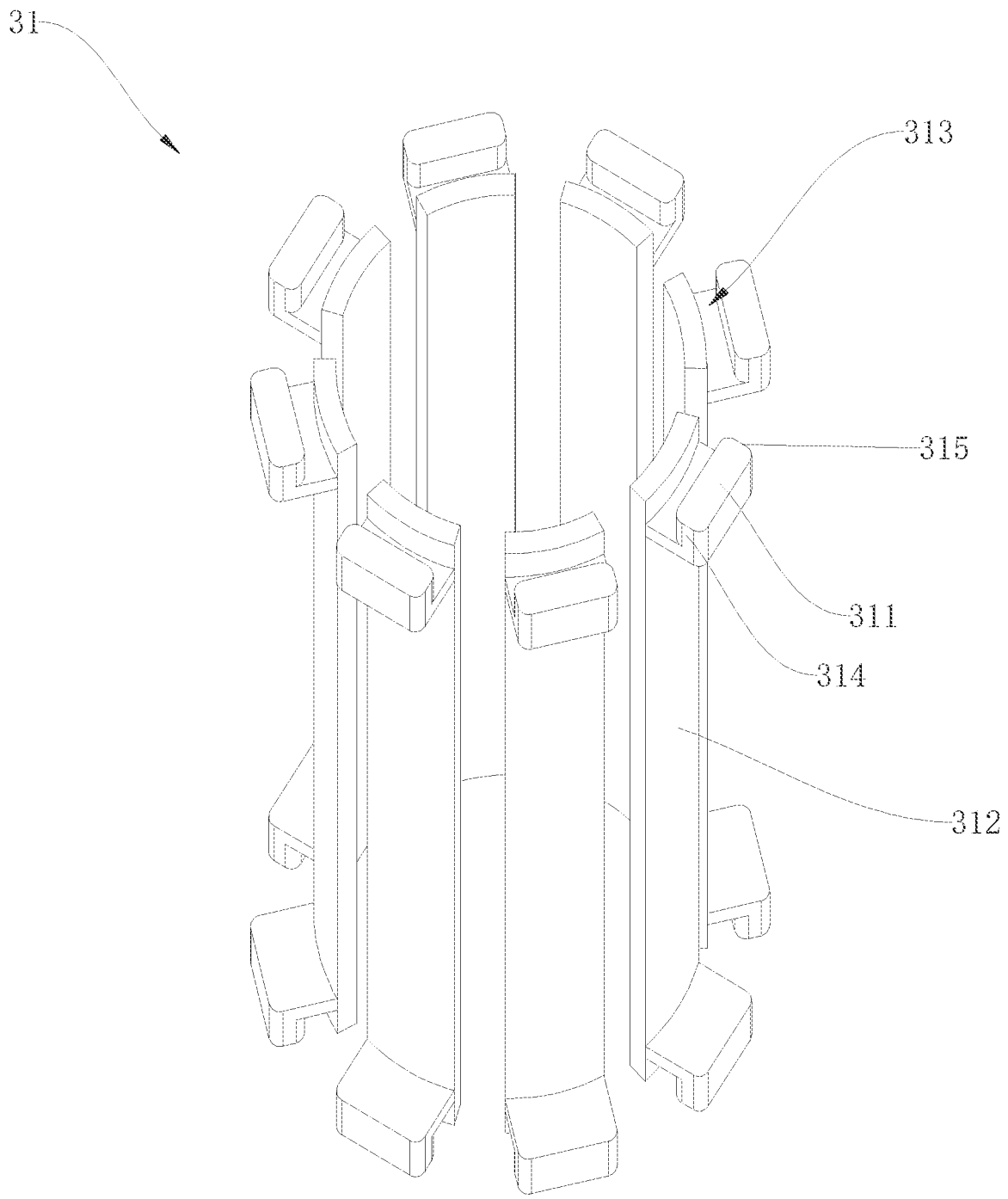
FIG. 10 is a structural view of a bearing assembly of the heat-not-burn cigarette according to an embodiment of the present invention.

During use, if a thin cigarette is used first, the thin cigarette is inserted into the accommodation cavity 11 through the opening 12 first. The heating plates 312 of the bearing assembly 31 are attached to the peripheral side of the thin cigarette to uniformly heat the thin cigarette. When close contact is required, the locking mechanism 30 is driven by the driving assembly 20 to perform a locking operation. The positioning portions 311 move inward along the first inner sections 333 of the guiding walls 332 to reduce an inner diameter of the bearing assembly 31, thereby allowing the heating plates 312 to be in attachment to the surface of the thin cigarette so as to lock the thin cigarette. There is no need to remove a cigarette butt 21 as a filter tip, and the thin cigarette can be inserted and used normally. To change to a thick cigarette, the driving assembly 20 drives the locking mechanism 30 to expand. The rotating disc 32 rotates clockwise to drive the positioning portions 311 to rotate clockwise. The positioning portions 311 move obliquely outward from the first inner sections 333 to the second inner sections 334 along the guiding walls 332. Meanwhile, the first side portions 314 and the second side portions 315 of the positioning portions 311 move radially outward along the side surfaces of the limiting slots 323. Thus, the inner diameter of the bearing assembly 31 is enlarged, and the heating plates 312 are attached to the surface of the thick cigarette for heating, as shown in FIG. 6. On the contrary, to change to a thin cigarette, the driving assembly 20 drives the locking mechanism 30 to contract. The rotating disc 32 rotates counterclockwise to drive the positioning portion 311 to rotate counterclockwise. The positioning portions 311 move obliquely inward from the second inner sections 334 to the first inner sections 333 along the guiding walls 332. Meanwhile, the first side portions 314 and the second side portions 315 of the positioning portions 311 move radially inward along the side surfaces of the limiting slots 323. Thus, the inner diameter of the bearing assembly 31 is reduced, and the heating plates 312 are attached to the surface of the thin cigarette for heating, as shown in FIG. 7. The heat-not-burn cigarette 1 has a compact structure, and its volume is reduced by 60% compared with a traditional heat-not-burn cigarette. The cigarette bodies 2 with different diameters are adjusted by the locking mechanism 30, such that the heating plates 312 are closely attached to the peripheral side of the cigarette body 2, so as to realize the rapid heating of the cigarette body 2. The design improves heating efficiency, reduces power consumption, and reduces power usage requirements. In addition, the heat-not-burn cigarette is universal, suitable for commercially available thin and thick cigarettes, and is easy to adjust, safe and reliable.

The basic principles, main features and advantages of the present invention are described above. Those skilled in the art should understand that the present invention is not limited by the foregoing embodiments, and the descriptions in the foregoing embodiments and specification are merely used for illustrating principles of the present invention. The present invention may have various modifications and improvements without departing from the spirit and scope of the present invention, and all these modifications and improvements should fall within the protection scope of the present invention. The protection scope of the present invention is defined by the appended claims and equivalents thereof.

What is claimed is:

1. A heat-not-burn cigarette, comprising a shell, a driving assembly, and a locking mechanism, wherein the shell is provided with an opening and an accommodation cavity; the opening communicates the accommodation cavity with an outside world; the locking mechanism is provided in the accommodation cavity; the driving assembly is transmissively connected to the locking mechanism to drive the locking mechanism to form a smaller clamping ring and a larger clamping ring; the locking mechanism comprises a bearing assembly and at least one transmission assembly; the bearing assembly is adjustably connected to the transmission assembly, and the transmission assembly is connected to the driving assembly, so as to provide preset tracks for the bearing assembly; and the bearing assembly expands or contracts along the preset tracks, such that the bearing assembly is adjustably attached to a peripheral side of a cigarette body.

2. The heat-not-burn cigarette according to claim 1, wherein the transmission assembly comprises a rotating disc and a guiding disc; the driving assembly is transmissively connected to the rotating disc; the bearing assembly is movably connected to the guiding disc and the rotating disc; and the preset tracks are formed between the rotating disc and the guiding disc, such that the bearing assembly moves clockwise outward or counterclockwise inward along the preset tracks.

3. The heat-not-burn cigarette according to claim 2, wherein the rotating disc is provided with a plurality of limiting slots; the limiting slots are circumferentially provided on an inner surface of the rotating disc; the guiding disc is provided with a plurality of guiding slots, and the guiding slots are spaced apart along a circumference of the guiding disc; each of the limiting slots and a respective one of the guiding slots are partially variably provided relative to each other; and the rotating disc is rotatable relative to the guiding disc, such that overlapping areas between the limiting slots and the guiding slots form the preset tracks, respectively.

4. The heat-not-burn cigarette according to claim 3, wherein the guiding disc is provided with a plurality of guiding walls; the guiding walls are respectively located on inner sides of the guiding slots; the bearing assembly comprises a plurality of positioning portions and a plurality of heating plates; the positioning portions respectively extend from the heating plates to the limiting slots of the rotating disc; the heating plates face the cigarette body to heat the cigarette body; positioning slots are formed between the positioning portions and the heating plates, respectively; and the guiding walls are respectively accommodated in the positioning slots, such that the positioning portions connect the guiding slots and the limiting slots, respectively.

5. The heat-not-burn cigarette according to claim 4, wherein the positioning portions each are provided with a first side portion and a second side portion; the first side portion and the second side portion are respectively located on two sides of each of the positioning portions; the first side portion and the second side portion are slidably in contact with side surfaces of each of the limiting slots, respectively, such that the positioning portions are respectively radially slidable along the limiting slots.

6. The heat-not-burn cigarette according to claim 4, wherein the guiding walls extend from an inner circumference of the guiding disc to an outer circumference of the guiding disc in a bend or a curved arc; the positioning portions clamp the guiding walls in the positioning slots, respectively; the guiding disc has a ring structure, and the guiding slots are arranged obliquely from the inner circumference of the guiding disc to the outer circumference of the guiding disc; the guiding slots each are wider in a middle portion than on two sides.

7. The heat-not-burn cigarette according to claim 4, wherein the guiding walls each are provided with a first inner section and a second inner section; the second inner section integrally obliquely extends outward from the first inner section, and the first inner section extends obliquely inward; the first inner section and the second inner section of each of the guiding walls are in a bent structure; and the first inner section and the second inner section define an angle of 160° to 170°.

8. The heat-not-burn cigarette according to claim 4, wherein the rotating disc is provided with a driving portion and a limiting portion; the driving portion is axially located outside the limiting portion; the driving portion is rotatably connected to the driving assembly; and the limiting slots are spaced apart on an inner surface of the limiting portion.

9. The heat-not-burn cigarette according to claim 4, wherein two transmission assemblies are provided; two of the positioning portions are respectively located at two ends of each of the heating plates; the transmission assemblies are respectively connected to two ends of the bearing assembly; the heating plates extend axially to be attached to the peripheral side of the cigarette body; the driving assembly comprises a driving wheel, a pair of driven wheels, a transmission rod and driving supports; the driving wheel and the driven wheels are axially arranged along the transmission rod; the driven wheels are respectively located at two ends of the transmission rod, and the driven wheels are respectively engaged with driving portions of rotating discs of the two transmission assemblies; the driving portions of the rotating discs each have a gear-shaped structure; the transmission rod penetrates the driving supports; guiding discs of the two transmission assemblies are respectively fixed to the driving supports; and the driven wheels are axially located outside the driving supports, respectively.

10. The heat-not-burn cigarette according to claim 4, wherein the heat-not-burn cigarette further comprises a power supply assembly and a control module; the control module is electrically connected to the power supply assembly, and the control module is configured to control a heating process and/or a driving process of the bearing assembly; the heating plates are electrically connected to the control module and the power supply assembly; the heating plates are electrothermal ceramic plates; the electrothermal ceramic plates are made of one or more selected from a group consisting of an oxide ceramic, a carbide ceramic, a nitride ceramic, and a boride ceramic; the limiting slots each have a U-shaped structure; the guiding slots each have a parallelepiped structure; and the guiding walls each are bent at an angle of 164° to 166°.

11. The heat-not-burn cigarette according to claim 5, wherein the heat-not-burn cigarette further comprises a power supply assembly and a control module; the control module is electrically connected to the power supply assembly, and the control module is configured to control a heating process and/or a driving process of the bearing assembly; the heating plates are electrically connected to the control module and the power supply assembly; the heating plates are electrothermal ceramic plates; the electrothermal ceramic plates are made of one or more selected from a group consisting of an oxide ceramic, a carbide ceramic, a nitride ceramic, and a boride ceramic; the limiting slots each have a U-shaped structure; the guiding slots each have a parallelepiped structure; and the guiding walls each are bent at an angle of 164° to 166°.

12. The heat-not-burn cigarette according to claim 6, wherein the heat-not-burn cigarette further comprises a power supply assembly and a control module; the control module is electrically connected to the power supply assembly, and the control module is configured to control a heating process and/or a driving process of the bearing assembly; the heating plates are electrically connected to the control module and the power supply assembly; the heating plates are electrothermal ceramic plates; the electrothermal ceramic plates are made of one or more selected from a group consisting of an oxide ceramic, a carbide ceramic, a nitride ceramic, and a boride ceramic; the limiting slots each have a U-shaped structure; the guiding slots each have a parallelepiped structure; and the guiding walls each are bent at an angle of 164° to 166°.

13. The heat-not-burn cigarette according to claim 7, wherein the heat-not-burn cigarette further comprises a power supply assembly and a control module; the control module is electrically connected to the power supply assembly, and the control module is configured to control a heating process and/or a driving process of the bearing assembly; the heating plates are electrically connected to the control module and the power supply assembly; the heating plates are electrothermal ceramic plates; the electrothermal ceramic plates are made of one or more selected from a group consisting of an oxide ceramic, a carbide ceramic, a nitride ceramic, and a boride ceramic; the limiting slots each have a U-shaped structure; the guiding slots each have a parallelepiped structure; and the guiding walls each are bent at an angle of 164° to 166°.

14. The heat-not-burn cigarette according to claim 8, wherein the heat-not-burn cigarette further comprises a power supply assembly and a control module; the control module is electrically connected to the power supply assembly, and the control module is configured to control a heating process and/or a driving process of the bearing assembly; the heating plates are electrically connected to the control module and the power supply assembly; the heating plates are electrothermal ceramic plates; the electrothermal ceramic plates are made of one or more selected from a group consisting of an oxide ceramic, a carbide ceramic, a nitride ceramic, and a boride ceramic; the limiting slots each have a U-shaped structure; the guiding slots each have a parallelepiped structure; and the guiding walls each are bent at an angle of 164° to 166°.

15. The heat-not-burn cigarette according to claim 9, wherein the heat-not-burn cigarette further comprises a power supply assembly and a control module; the control module is electrically connected to the power supply assembly, and the control module is configured to control a heating process and/or a driving process of the bearing assembly; the heating plates are electrically connected to the control module and the power supply assembly; the heating plates are electrothermal ceramic plates; the electrothermal ceramic plates are made of one or more selected from a group consisting of an oxide ceramic, a carbide ceramic, a nitride ceramic, and a boride ceramic; the limiting slots each have a U-shaped structure; the guiding slots each have a parallelepiped structure; and the guiding walls each are bent at an angle of 164° to 166°.

* * * * *